United States Patent [19]

Tepsa et al.

[11] 4,327,818

[45] May 4, 1982

[54] SKY SHEPHERD 1

[76] Inventors: Brian Tepsa, c/o George Spector, 3615 Woolworth Bldg., 233 Broadway; George Spector, 3615 Woolworth Bldg., 233 Broadway, both of New York, N.Y. 10007

[21] Appl. No.: 119,385

[22] Filed: Feb. 7, 1980

[51] Int. Cl.[3] ..... A62B 1/12

[52] U.S. Cl. ..... 182/238; 182/233; 182/235

[58] Field of Search ..... 182/5-7, 182/70-75, 236-240, 231-235

[56] References Cited

U.S. PATENT DOCUMENTS

| | | | |
|---|---|---|---|
| 526,385 | 9/1894 | Dymacek | 182/238 |
| 728,145 | 5/1903 | Triplett | 182/238 |
| 1,206,676 | 11/1916 | Cote | 182/239 |
| 1,528,803 | 3/1925 | Tock | 182/240 |
| 1,625,221 | 4/1927 | Nykolyshak | 182/237 |
| 2,502,896 | 4/1950 | Sherbrook | 182/238 |
| 2,561,832 | 7/1951 | Wilson | 182/235 |
| 3,893,541 | 7/1975 | Servais | 182/238 |

*Primary Examiner*—Reinaldo P. Machado

[57] ABSTRACT

An apparatus for persons to be lowered to a ground from upper stories of buildings, in case of a fire, or the like; the device including a frame suspended outside a window, two heels of ropes supported on the frame, a seat on the end of each rope, one rope winding up automatically as the other unwinds, and a speed-damping mechanism to retard too fast descent of a lowering person.

1 Claim, 5 Drawing Figures

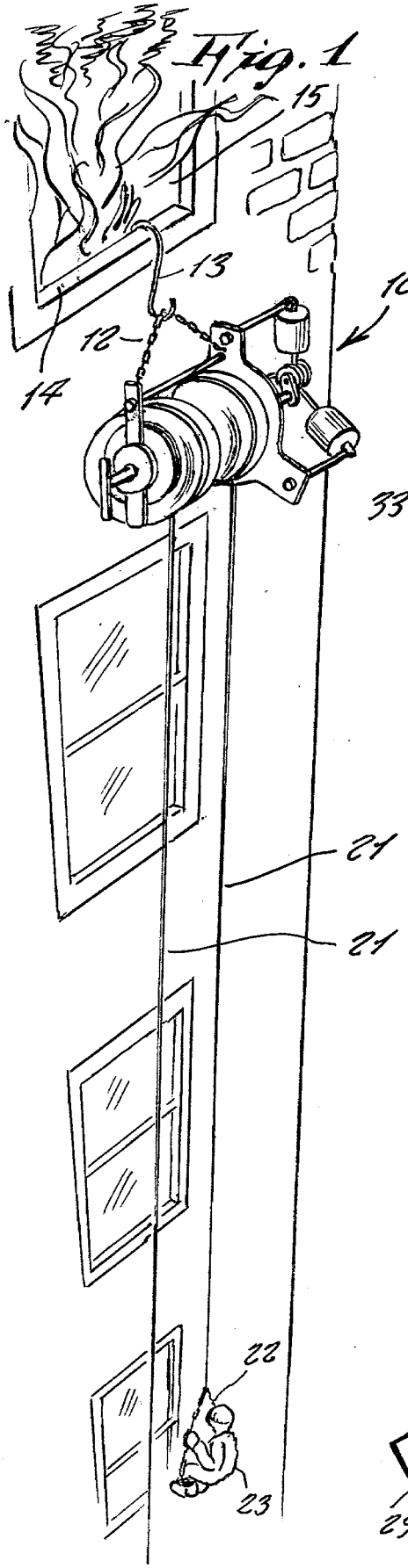
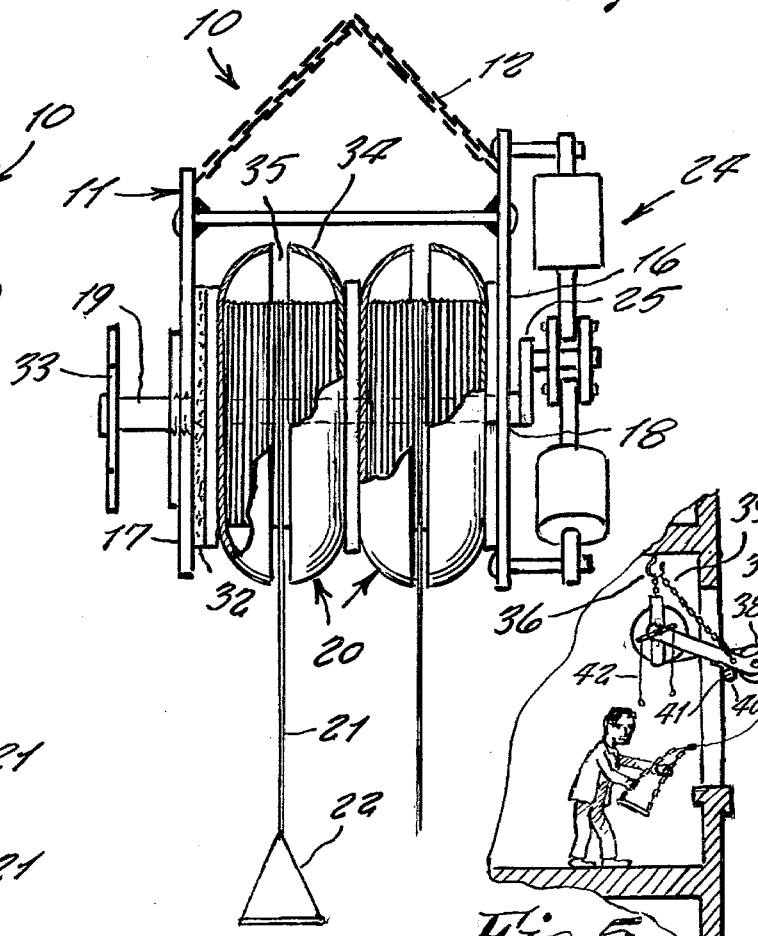
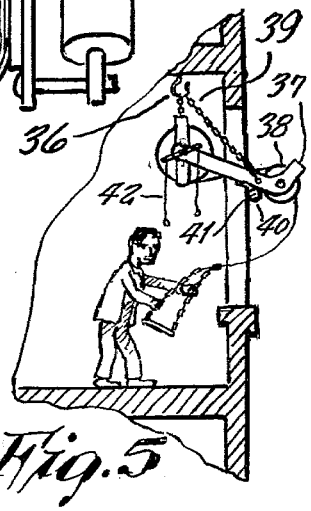
Fig. 5
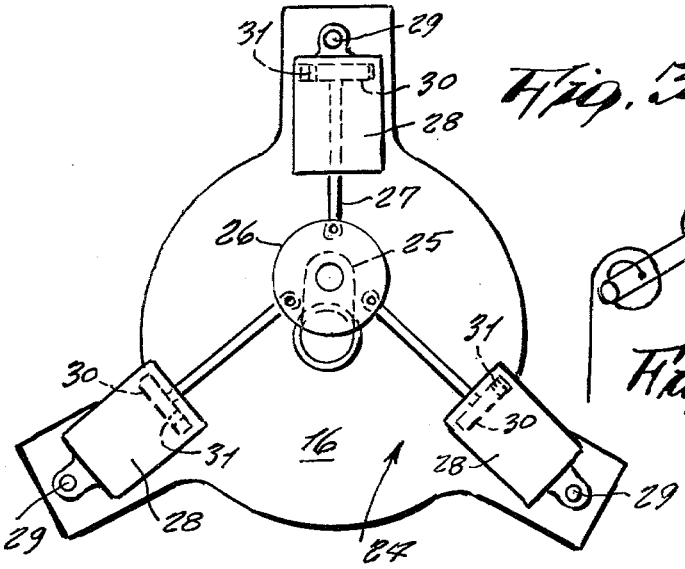
Fig. 3
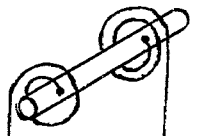
Fig. 4

SKY SHEPHERD 1

This invention relates generally to fire escape equipment.

It is well known that in spite of the provisions of fire escape means in all taller buildings, a great many persons are killed in building fires due to not being able to get out, for various reasons. The fire escape may be too far away from them to reach. Its access may be temporarily blocked by some violation, or the like. This situation is accordingly in need of an improvement.

Therefore it is a principal object of the present invention to provide a sky shepherd I fire escaping equipment that is relatively a small, portable winch that can be quickly and easily installed at any window of a building so as to allow persons to lower themselves to a ground; the winch size depending upon the length of cable wound therearound, and which can be made to accomodate building floors from a second story to that of a tallest skyscraper.

In the drawing:

FIG. 1 is a perspective view of the invention shown in operative use outside of a window of a tall building.

FIG. 2 is a side view thereof shown partly in cross section.

FIG. 3 is an end view thereof.

FIG. 4 is a diagrammatic view showing two cables wound in opposite directions around a shaft of the invention, the drums thereof not being shown, for simplicity of the diagram.

FIG. 5 is a side view of a modified design of the invention for being installed from a room-ceiling, so as to allow a person to leave the room already suspended on the sear and be a less frightening experience.

Referring now to the drawing in greater detail, and more particularly to FIGS. 1 through 4 thereof at this time, there is a sky shepherd I fire escape device 10 according to the present invention, wherein a rigid, strong frame 11 has a chain 12 across its top for suspension from a hook 13 that can be hooked over a sill 14 of a building window 15. Each side plate 16 and 17 of the frame has a bearing 18 installed therein for suitably supporting a freely rotatable shaft 19 therebetween, and on which a pair of pulley-like drums 20 are affixed, each drum having a strong, aircraft type, cable 21 secured at its end thereto and wound up around the same. As shown in FIG. 4, the cables of each drum are wound in opposite directions, so that as one cable winds up the other one unwinds. A seat 22 is attached to an outer end of each of the cables, for a person 23 to sit thereupon when being lowered to a ground.

The present device includes a damping mechanism 24 for retarding too rapid and uncontrolled rotation of the drums caused by the weight of the person being lowered. The mechanism includes a crank 25 on one end of the shaft 19, a rotatable plate 26 on the crank end to which piston rods 27 of three circularly equally spaced apart hydraulic cylinders 28 are pivotally connected, the cylinders being pivotally supported by means of pins 29 on the side plate 16. Damping of the shaft rotation and the sliding of the pistons 30 inside the cylinders is achieved by controlled flow of oil through a residual hole 31 in the piston in its movement between chambers on opposite sides of the piston.

Additionally, a clutch plate 32 can be controlled by a pivotable lever 33 so to screw against a side of one of the drums and arrest the shaft rotation as desired by a person near the same so that a descent of another lowering person is controlled.

It is to be noted that a shield 34 integral with each drum encloses the wound up portion of the cable, and a narrow slit 35 around a center of the shield, allows the cable to pay out or wind up in a trouble free manner without tangle.

In operative use, as one person is lowered, the other seat is being raised the weight of the descending person powering the device. Thus throughout its operation, a person is being lowered, so that is a short time, a great many may escape.

In FIG. 5, another design of sky shepherd I is shown wherein the same is not suspended outside a window, but is suspended from a ceiling hook 36 inside a room, so that it is a less frightening experience than stepping outside the window with the cable-supporting drums being located lower than the person. In this design the seat is already suspended from the drum as the person steps out of the window. In this design, and additional, U-shaped yoke 37 around the frame, pivots from the shaft 19 and carrier pulleys 38 at its outer end over which the cables pass; the pulleys extending outside of the window so to allow the cables to hang vertically therefrom, instead rubbing against the window sill if coming from the drums directly. A chain 39 holds the yoke in a sidward lowered position. In order to maintain the yoke protruding out of the window a ring 40 is rigidly mounted under each leg of the U-shaped yoke, so that a strong metal bar 41 can be inserted therein the bar being longer than the width of the window opening so that opposite ends of the bar rest against the outer side of the building wall, as shown, preventing the yoke from swinging into the room.

In use, a person simply fits the seat around him while in the room, and then steps out of the room, with a feeling of greater security by being already suspended.

Cords 52 attached to lever 33 allow control thereof from overhead.

What is claimed as new, is:

1. A fire escape device, comprising in combination a frame and means for supporting said frame on a structure, including, a rotatable, horizontal shaft through said frame, a pair of spaced parallel drums affixed on said shaft, a cable wound oppositely on each said drum in further combination with a damping mechanism and a clutch, wherein said mechanism is mounted on one side of said frame and the clutch on the opposite side with the drums therebetween, said mechanism being operatively connected to said shaft, wherein said means comprise a support mounted within said structure and a cable supporting yoke pivotally mounted on said frame extending outward of said structure supporting said cables in further combination with a retainer for maintaining said yoke externally of said structure wherein said damping mechanism comprises a crank connected to said shaft further including hydraulic cylinder pistons engaging said crank for retardation purposes.

* * * * *